US005549454A

United States Patent [19]

Earle

[11] Patent Number: 5,549,454

[45] Date of Patent: Aug. 27, 1996

[54] HIGH SPEED VACUUM PUMP WITH REDUCED EXHAUST NOISE

[75] Inventor: Stephen R. Earle, Pudsev, United Kingdom

[73] Assignee: WABCO Automotive U.K. Limited, Leeds, United Kingdom

[21] Appl. No.: 206,786

[22] Filed: Mar. 4, 1994

[30] Foreign Application Priority Data

Mar. 4, 1993 [GB] United Kingdom ..... 9304445

[51] Int. Cl.[6] ..... F04B 53/16

[52] U.S. Cl. ..... 417/312; 92/170.1

[58] Field of Search ..... 417/312, 313, 417/415, 540; 92/171.1, 170.1; 181/202, 229

[56] References Cited

U.S. PATENT DOCUMENTS

| | | | |
|---|---|---|---|
| 411,810 | 10/1889 | Marwick | 417/534 |
| 586,736 | 7/1897 | Diss | 417/534 |
| 1,854,773 | 4/1932 | Tannehill | 92/171.1 |
| 1,964,515 | 6/1934 | Hodsdon | 92/171.1 |
| 2,174,805 | 10/1939 | Raulerson | 417/534 |
| 2,410,976 | 11/1946 | Johns | 92/170.1 |
| 2,674,406 | 4/1954 | Heckendorf | 230/232 |
| 2,846,140 | 8/1958 | Kemper et al. | 417/458 |
| 2,954,675 | 10/1960 | Reynolds | 92/171.1 |
| 3,500,759 | 7/1970 | Potter et al. | 92/171.1 |
| 3,800,751 | 4/1974 | Glassey et al. | 92/171.1 |
| 3,839,946 | 10/1974 | Paget | 92/170.1 |
| 3,877,842 | 4/1975 | Greene et al. | 417/312 |
| 4,221,196 | 9/1980 | Castarede | 123/41.84 |
| 4,393,752 | 7/1983 | Meier | 92/171.1 |

FOREIGN PATENT DOCUMENTS

| | | | |
|---|---|---|---|
| 325695 | 8/1989 | European Pat. Off. . | |
| 1529-380 | 5/1968 | France . | |
| 0886551 | 8/1953 | Germany | 92/170.1 |
| 1503405 | 7/1965 | Germany . | |
| 3150119 | 6/1983 | Germany . | |
| 3231957 | 3/1984 | Germany . | |
| 691420 | 5/1913 | United Kingdom | 92/170.1 |
| 1190477 | 5/1970 | United Kingdom | 92/171.1 |

*Primary Examiner*—Peter Korytnyk
*Attorney, Agent, or Firm*—Stroock & Stroock & Lavan

[57] ABSTRACT

A vacuum pump comprises a casing body (11,12) having a cylinder liner (16) therein which defines a primary exhaust passage between the outer wall of the liner and the inner wall of the body. The exhaust passage includes restrictors (20, 21), which permit the spaces (37,38) in the interior of the body to be used as silencer chambers.

11 Claims, 2 Drawing Sheets

HIGH SPEED VACUUM PUMP WITH REDUCED EXHAUST NOISE

BACKGROUND OF THE INVENTION

This invention relates to vacuum pumps and is particularly concerned with reducing exhaust noise thereof.

Vacuum pumps, particularly small high speed vacuum pumps, can be very noisy in operation. Most noise emanates from the exhaust area and is a result of air being pumped out in a series of rapid undamped blasts. It is possible to fit a silencer to the exhaust port, but such silencers increase the pump cost and may add to the overall pump size at a time when manufacturers are seeking to minimize size cost and material content as much as possible.

High speed electrically driven vacuum pumps for vehicles pose particular problems since it is essential that such pumps are very quiet in operation yet take up the minimum space possible. Such pumps should be adaptable to many different installation sites yet be of a common reliable and economical design. Above all such pumps must not be unduly expensive.

SUMMARY OF THE INVENTION

According to the invention there is provided a vacuum pump having a body, a cylinder liner in the body defining a pumping bore, a piston reciprocal in the bore, inlet valve means and outlet valve means characterized in that, at least one exhaust passage is provided through said body between said cylinder liner and the body.

Preferably said passage extends from one end of said liner to the other end of said liner.

Such an arrangement allows the crankcase volume to be utilized as a damping chamber; said passage may include flow restrictors to achieve a desired silencing effect.

The pump body may include partitions to divide said body into several chambers of relatively large volume; such volumes may constitute a plurality of damping chambers linked by flow restricting orifices. This arrangement is particularly convenient where the body is a die cast or plastics moulding having internal walls to support e.g. an electric motor.

The exhaust outlet to atmosphere may be arranged at any convenient point on the pump body, and the flow path of exhaust air designed accordingly. In this way the pump may be adapted to a wide variety of installation sites. The pump cylinder head may provide a further relatively large volume chamber for use in the exhaust air flow circuit.

In a preferred embodiment the portion of the pump body into which the cylinder liner is received is circular, and the cylinder liner has a polygonal periphery, the rounded corners of the polygon being an interference fit in said portion of the pump body. This arrangement provides secure retention of the cylinder liner without distortion of the cylinder bore. A further advantage is that the flats between the polygon apices define flow passages for exhaust air.

In a preferred embodiment the cylinder liner is polygonal over only a portion of its length, other portions of the cylinder liner may be substantially circular and fit closely to the circular wall of the cylinder liner. These latter portions may have one or more apertures drilled or otherwise formed therein to define flow restrictors—the size of such restrictors may be readily changed to suit different pump applications.

BRIEF DESCRIPTION OF THE DRAWINGS

Other features of the invention will be apparent from the following description of a preferred embodiment shown by way of example only with reference to the accompanying drawings in which.

DETAILED DESCRIPTION OF THE PREFERRED EMBODIMENTS

Figure 1:
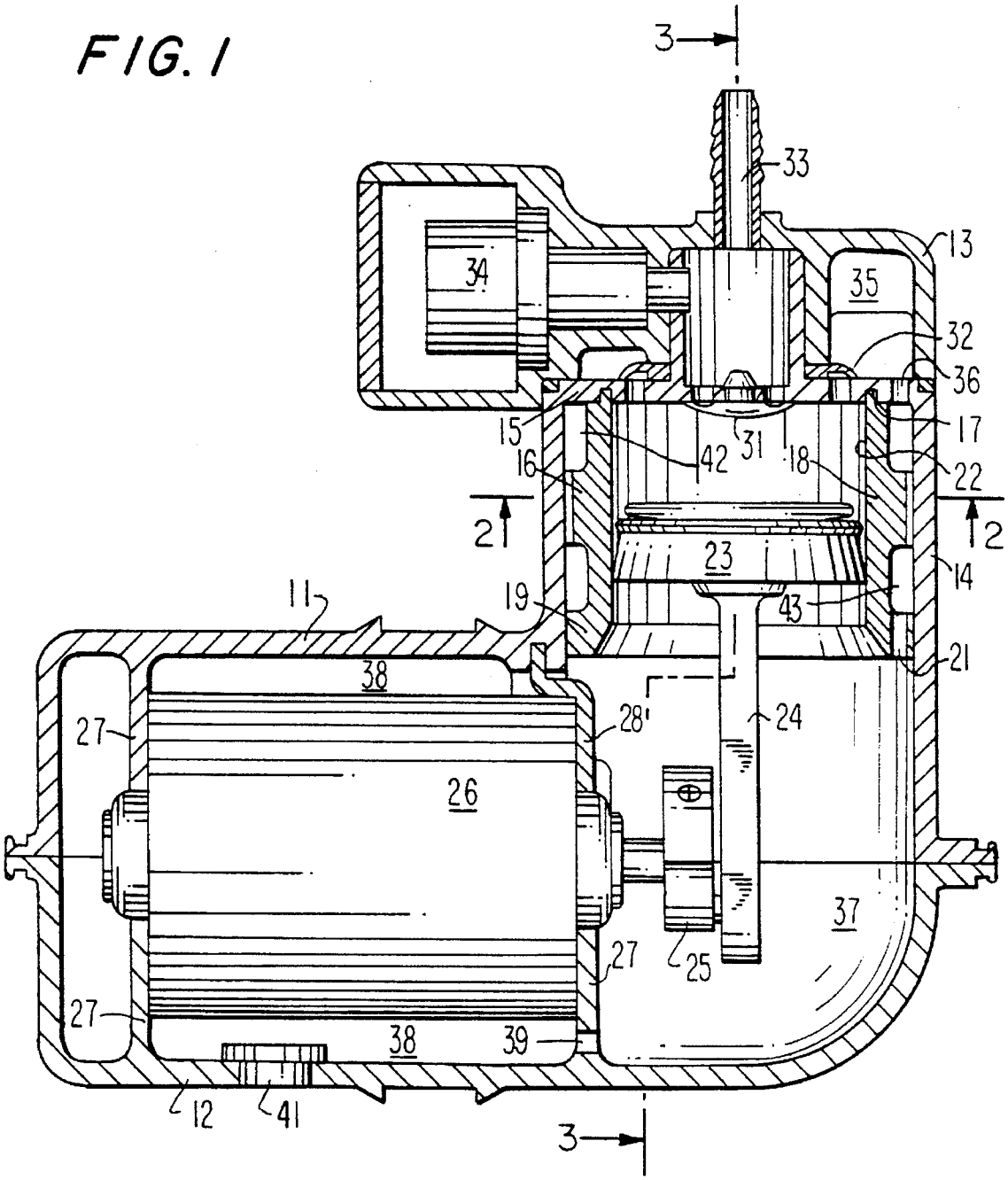
FIG. 1 is an axial section through an electrically driven vacuum pump incorporating the invention.

The drawings illustrate an electrically driven vacuum pump comprising an upper casing 11, a lower casing 12 and a cylinder head 13. The upper casing includes a cylindrical portion 14 having a substantially closed upper end 15. The components 11, 12 and 13 may be of die cast aluminium.

Figure 2:
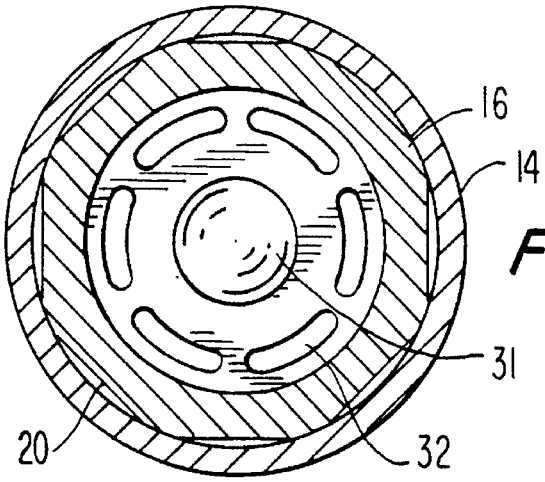
FIG. 2 is a transverse section on line 2—2 of FIG. 1.
Figure 3:
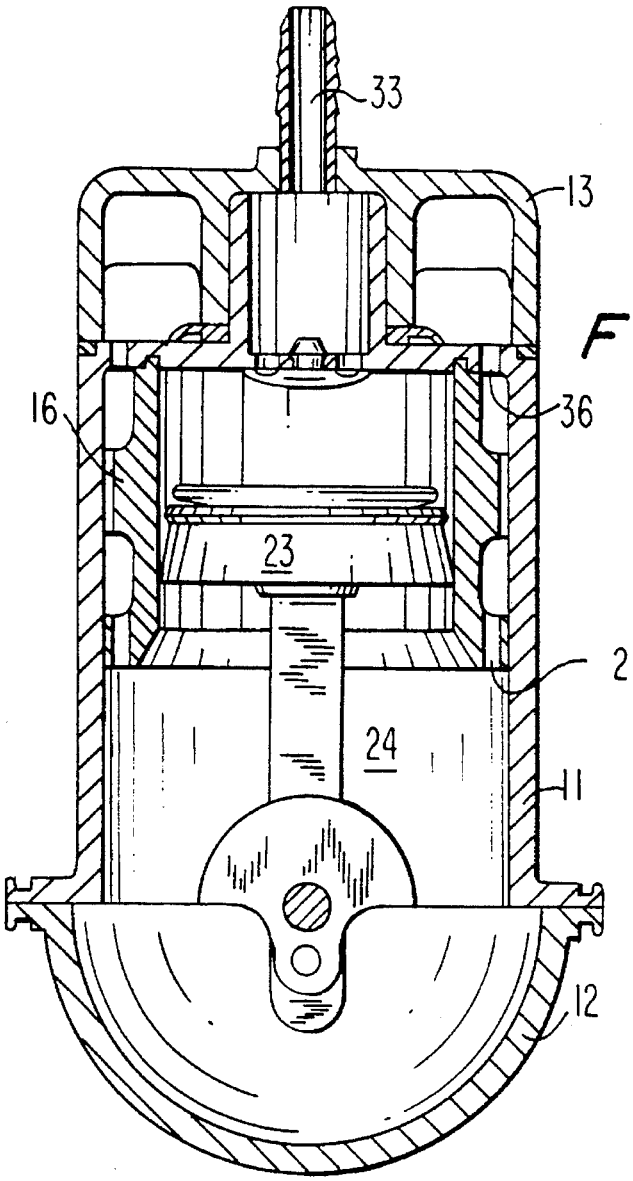
FIG. 3 is an axial section on stepped line 3—3 of FIG. 1.

A cylinder liner 16 having a one end and another end is pressed into the cylindrical portion 14 and has an annular projection 17 locating in a corresponding groove of the upper end 15. The liner has a substantially octagonal central flange 18 (as illustrated best in FIG. 2) which is interference fit in the cylindrical portion 14. The flats of the central flange define flow restrictors 20 with annular chambers 42,43 on either side thereof. A bottom flange 19 of the liner 16 is a close fit in the cylindrical portion 14 and has a number of apertures 21 therethrough. The liner is cut away circumferentially above and below the central flange 18 to reduce material content and to ease molding and assembly. The liner may be of a plastic material, such as mineral filled nylon.

Reciprocating in the cylinder bore 22 is a piston 23 driven by a connecting rod 24 itself driven by the crankshaft 25 of an electric motor 26. The motor 26 is retained by internal walls 27 of the upper and lower casings, and a mounting plate 28; electrical connections are by any suitable means.

The upper end 15 of the upper casing defines the ports of an inlet valve 31 and a concentric outlet valve 32. The inlet valve is connected to an inlet pipe 33 for connection to e.g. a vacuum reservoir (not shown). The cylinder head 13 houses a pressure switch 34 operable to switch off the pump when the desired level of vacuum is attained. An annular exhaust chamber 35 formed in the cylinder head is connected through ports 36 to the annular chamber surrounding the cylinder liner 16 forming a primary exhaust passage.

The crankcase 37 and annular space 38 surrounding the motor 26 define relatively large volume chambers connected by a plurality of ports 39. An exhaust port includes a filter 41 provided in the wall of the lower casing as illustrated and provides an exit path to atmosphere. Several exhaust ports may be provided if desired.

In use exhaust from valve 32 passes through the series of restrictors 36,20,21,39 and chambers 42,43,37,38 to the exhaust filter 41, rather than direct to atmosphere. By careful choice of restrictor size and chamber volume the exhaust may be effectively silenced without any substantial modification of the pump or increase in manufacturing cost. Electrically driven vacuum pumps usually run at a fixed speed and the silencing arrangement may also be tuned to obtain the maximum gas throughput. The invention is however also useful in mechanically driven vacuum pumps, including those for vehicles where the operating speed may be dependent on e.g. engine speed.

I claim:

1. A vacuum pump having a casing, an insertable cylinder liner, having a one end and an other end inserted in said casing and defining a pumping bore within the cylinder liner, a piston reciprocal in the pumping bore, an inlet valve to admit fluid into the pumping bore and an outlet valve to exhaust fluid from the pumping bore wherein an annular chamber is formed between said cylinder liner and said casing and a crankcase is provided in the casing, said annular chamber defining a primary exhaust passage extending from said one end of the liner to said other end and having at one end a port in fluid communication with said outlet valve and at the other end an aperture in fluid communication with said crankcase.

2. A pump according to claim 1, wherein at least one of said port and said aperture includes a flow restrictor.

3. A pump according to claim 1 and having at least one internal wall disposed within said casing, said wall defining exhaust chambers on either side thereof, and at least one part formed in the wall.

4. A pump according to claim 3, wherein at least one of said port and said aperture includes a flow restrictor.

5. A pump according to claim 1 wherein the radially outer surface of the liner is substantially polygonal.

6. A pump according to claim 5 wherein corners of said liner are in an interference fit with said casing.

7. A pump according to claim 6 wherein the radially outer surface of said liner is substantially polygonal over a portion of its length only.

8. A pump according to claim 5 wherein said radially outer surface of said liner is substantially polygonal over a portion of its length only.

9. A pump according to claim 8 wherein said portion is substantially midway between the ends of the liner.

10. A pump according to claim 7 wherein said liner further includes a radially extending flange substantially at one end thereof, said flange being a close fit in said body and having one or more apertures therein.

11. A pump according to claim 1 wherein said liner is of plastics material.

* * * * *